United States Patent [19]

Richardson

[11] Patent Number: 4,479,170

[45] Date of Patent: Oct. 23, 1984

[54] GUIDING LIGHT SYSTEM

[76] Inventor: Bobby J. Richardson, 2303 Cottonwood, Norman, Okla. 73071

[21] Appl. No.: 493,069

[22] Filed: May 9, 1983

[51] Int. Cl.[3] ..... F21V 33/00

[52] U.S. Cl. ..... 362/95; 362/147; 362/226; 362/251; 362/295; 362/362; 200/315

[58] Field of Search ..... 362/95, 147, 226, 251, 362/295, 362; 200/315

[56] References Cited

U.S. PATENT DOCUMENTS

| | | | |
|---|---|---|---|
| 2,494,560 | 1/1950 | Kaupp | 362/95 X |
| 4,037,221 | 7/1977 | Alexander | 362/100 X |
| 4,038,582 | 7/1977 | Horwinski | 362/95 X |
| 4,255,780 | 3/1981 | Sakellaris | 362/95 X |

*Primary Examiner*—Stephen J. Lechert, Jr.

[57] ABSTRACT

This invention is a wall-mounted electric switch, having a toggle switch unit, with a button that is pivotable to three positions, and the button including an illuminating lamp.

1 Claim, 5 Drawing Figures

GUIDING LIGHT SYSTEM

This invention relates generally to signaling devices. More specifically, it relates to household wall-mounted electric switches.

It is well known that sometimes a household resident wishes to identify his particular residence for a person trying to locate it, for arrival there, such as, for example: a doctor or police, in case of emergency, a taxi driver, or just a visiting friend unfamiliar with the location. This can be especially difficult during evening or nighttime hours, when there is not daylight to help. In such situations, the usual practice is to turn on a light, to serve as a beacon. However, if other neighboring houses are also lighted at such time, then this will not be helpful enough, so that this situation is, accordingly, in need of an improvement.

Therefore, it is a principal object of the present invention to provide an electric switch that conventionally turns a light on and off, and which additionally controls a signal light.

Another object is to provide a guiding light system, wherein a small lamp at the switch button also becomes illuminated when the signal light is turned on, so that, if the signal light is located some distance away, such as at a front yard gate, outside on a porch, or outside an apartment, a resident is then reminded that it is turned on.

Yet a further object is to provide a guiding light system, wherein a lamp conventionally serviced by the switch to turn on and off, is also serviced to become the signal lamp, such as by blinking, whenever so wished.

Other objects are to provide a guiding light system, which is simple in design, inexpensive to manufacture, rugged in construction, easy to use, and efficient in operation.

These, and other objects, will be readily evident, upon a study of the following specification, and the accompanying drawing, wherein.

Figure 1:
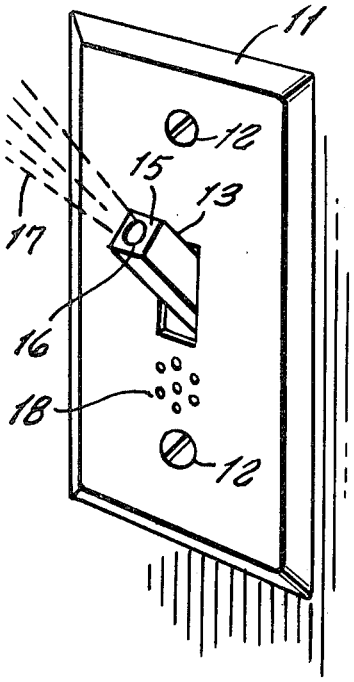
FIG. 1 is a front perspective view of a single unit, that incorporates the present invention.
Figure 2:
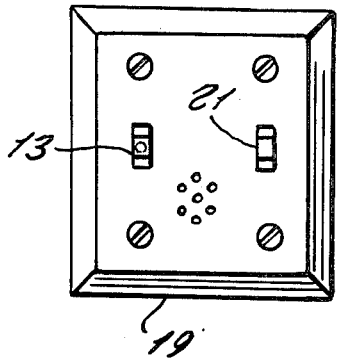
FIG. 2 is a front elevation view of a double switch unit, that incorporates the same.
Figure 3:
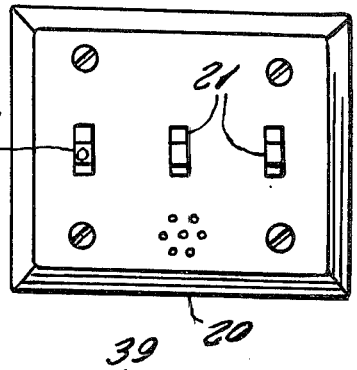
FIG. 3 is a front elevation view of a triple switch unit, that incorporates the same.
Figure 4:
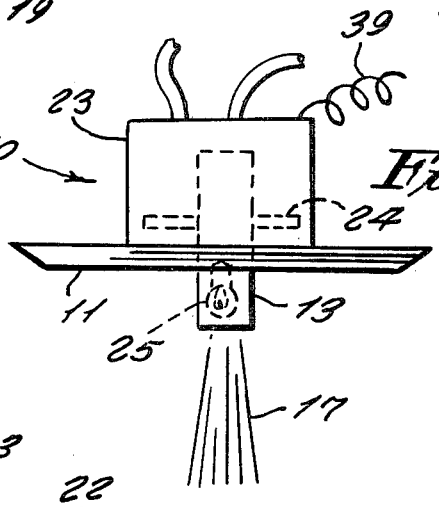
FIG. 4 is a top plan view of the unit shown in FIG. 1.

Referring now to the drawing in greater detail, the reference numeral 10 represents an electric switch, according to the present invention, and which may be made such as a conventional wall-mounted model, that is installed on a wall of a house or building, for operating an illuminating lamp, and which, as shown in FIG. 1, includes a front wall single switch plate 11, secured in position by screws 12. A manually operatable button 13 on one end of a rocking lever of a toggle switch 14 projects forwardly through the plate. In the present invention, the outer end wall 15 of the button includes a hole 16, through which light rays 17 may pass, for serving as a steady night light, and also, when blinking, to notify a resident that a signal light is in an operating "on" position. A grill 18 through the plate permits sound to be heard from a buzzer or beeper (not shown), but which may be included inside the switch housing, for additionally audibly notifying the resident when the signal light is on. As shown in FIGS. 2 and 3, the present invention may be incorporated in switches having either a double switch plate 19, triple switch plate 20, or the like, for a plurality of other toggle switch buttons 21.

Figure 5:
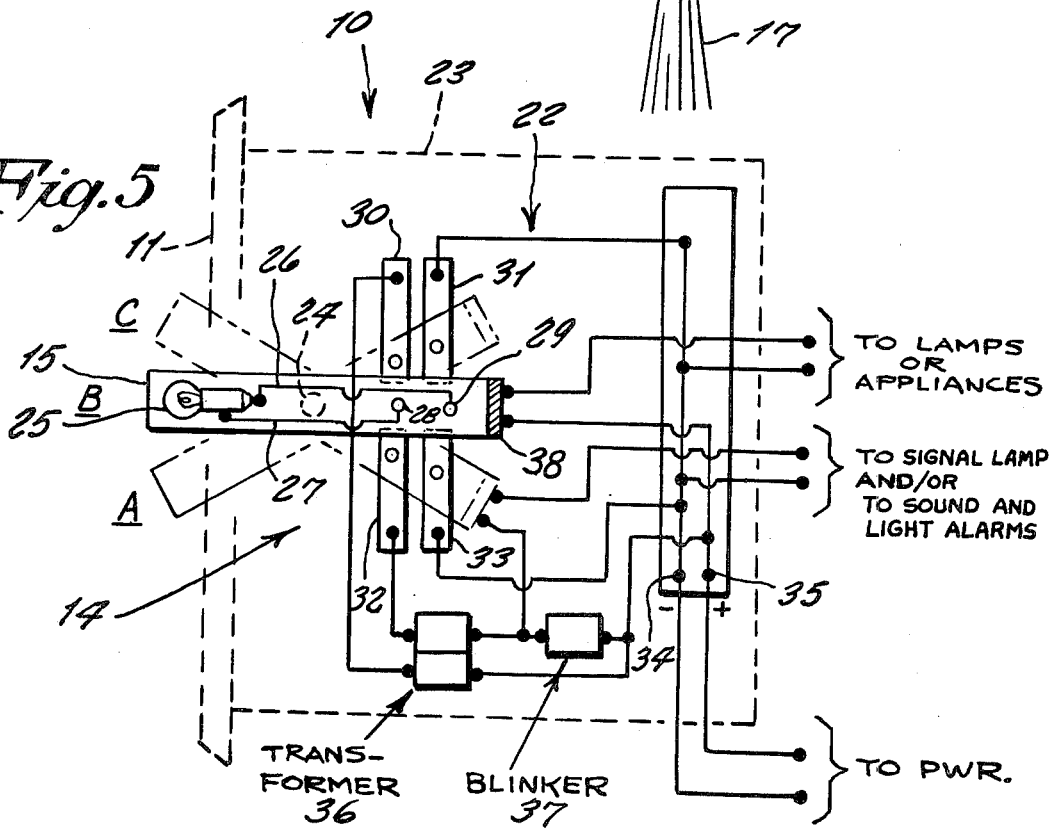
FIG. 5 is an electrical diagram, showing the operation thereof.

FIG. 5 illustrates diagrammatically an electric circuit 22 located inside the switch housing 23, and which is controlled by the button 13. The lever is pivotable on a cross pin 24, supported on the housing, so as to be movable into three different positions—A, B, or C.

In an "off" position A, the button is pivoted into a conventional downward direction, so that power is cut off to a normally used illumination lamp in a house and which is serviced by the toggle switch. When the button is flipped into a middle direction, or "on" position B, power is connected through the toggle switch to the serviced illumination lamp. However, when the button is flipped upwardly, into a position "C", then power is turned off to the serviced illumination lamp, while, at the same time, the power is turned on to the signal lamp. It is to be noted that when the button is in position A, the light rays 17, from the button, glow steadily, so as to serve as a night light, in order to locate the button in nighttime darkness. When the button is in position B, the light rays 17 are turned off, as there is no need of them. When the button is in position C, the light rays 17 will blink, as shown in FIG. 1, in order to inform a resident noticeably that the signal lamp is on. If the toggle switch 14 is used to service an appliance, instead of an illumination lamp, as described above, then the wiring connections inside the switch may be slightly reversed, so that, in position A, the light rays 17 are off, but in position B, they are on, in order to notify the resident that the appliance is left on. In FIG. 5, the wiring connection is shown to provide lamp illumination, instead of appliance power.

A miniature electric lamp 25 is located inside the button hole 16. Wire conductors 26 and 27 from the lamp extend to contacts 28 and 29, which are engagable with either a pair of contact plates 30 and 31, or contact plates 32 and 33, depending upon the direction into which the button is pivoted. The contact plates are connected to negative and positive terminals 34 and 35 of a power source. In position B, no power connection is provided to the contacts 27 and 28. A transformer 36 steps down the power to the miniature lamp, while a blinker unit 37 controls intermittent power to both the miniature lamp and to the signal lamp. A contact bar 38, on a rear end of the lever, closes (in position) the circuit to the illumination lamp or appliance, and (in position C) closes a circuit to the sound beeper, the signal lamp and possibly to a sound alarm as well. A pigtail 39, from the housing, serves for connection to any other device that is also wished to be activated.

A remote control system might be incorporated, for a handicapped or bed-ridden person to operate the toggle switch button.

While various changes may be made in the detail construction, it is understood that such changes will be within the spirit and scope of the present invention, as is defined by the appended claims.

What I claim as new is:

1. A guiding light system, comprising, in combination, an electric switch assembly, including a housing, a front plate on said housing, a toggle switch unit inside said housing having an outwardly protruding button through an opening in said front plate, said housing having three positions into which said button is selectively pivotable; a lowermost of said positions being an "off" position for electrical devices powered through said toggle switch unit, a middle one of said positions being an "on" position for said electrical devices, and an uppermost of said positions being an "off" position for said electrical devices while at the same time being a "blinking on" position for a remotely located signal lamp and a lamp on said button, said lowermost position being a "steady lighted on" position for said signal lamp and said button lamp, and said middle position being an "off" position for said signal lamp and said button lamp; said button being affixed on one end of a pivoted rocking lever, a contact plate affixed on an opposite end of said lever for selectively providing circuit closure means between a first pair of spaced-apart, stationary contacts of a power circuit to said electrical devices or providing circuit closure means between a second pair of spaced-apart, stationary contacts of a power circuit to said signal lamp; said button lamp being connected to a pair of contacts carried on said rocking lever, and which are selectively engagable either with a third or a fourth pair of stationary contacts, said third pair being in a power circuit including a step down transformer, and said fourth pair being in a power circuit including a blinker unit and a step down transformer; said first pair of contacts being engaged by said contact plate when said button is in said middle position, said second pair of contacts being engaged by said contact plate when said button is in said uppermost position, said third pair of contacts being engaged by said lever-carried contacts when said button is in said lowermost position, and said fourth pair of contacts being engaged by said lever-carried contacts when said button is also in said uppermost position.

* * * * *